US008684202B2

(12) United States Patent
Reisig

(10) Patent No.: US 8,684,202 B2
(45) Date of Patent: Apr. 1, 2014

(54) ELLIPTICAL BOTTLE NECK

(75) Inventor: Karl A. Reisig, Maumee, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 556 days.

(21) Appl. No.: 12/827,467

(22) Filed: Jun. 30, 2010

(65) Prior Publication Data

US 2012/0000878 A1 Jan. 5, 2012

(51) Int. Cl.
*B65D 1/02* (2006.01)
*B65D 23/10* (2006.01)

(52) U.S. Cl.
USPC ..... 215/40; 215/384

(58) Field of Classification Search
USPC ..... 215/40, 384; D9/542, 537, 536, 539, D9/500
See application file for complete search history.

(56) References Cited

U.S. PATENT DOCUMENTS

| | | | | | |
|---|---|---|---|---|---|
| D92,953 | S | | 8/1934 | Gaynor | |
| D155,061 | S | | 8/1949 | Williams | |
| D198,871 | S | * | 8/1964 | Akeireb | D9/539 |
| 3,857,506 | A | * | 12/1974 | Hafele | 215/46 |
| D236,434 | S | | 8/1975 | Shine | |
| 3,957,168 | A | * | 5/1976 | Shine et al. | 604/403 |
| D266,189 | S | * | 9/1982 | Safianoff | D24/117 |
| 4,508,236 | A | * | 4/1985 | Keilman et al. | 215/308 |
| 4,573,595 | A | * | 3/1986 | Mednis | 215/10 |
| 5,246,142 | A | * | 9/1993 | DiPalma et al. | 222/129 |
| 5,713,681 | A | * | 2/1998 | Venne et al. | 401/202 |
| 6,786,344 | B2 | * | 9/2004 | Kipperman et al. | 215/11.1 |
| D508,409 | S | | 8/2005 | Hewson | |
| D511,300 | S | | 11/2005 | Hewson | |
| 2009/0053374 | A1 | | 2/2009 | Finn | |
| 2010/0181278 | A1 | * | 7/2010 | Martin | 215/40 |

FOREIGN PATENT DOCUMENTS

| | | |
|---|---|---|
| DE | 20 2005 004 117 U1 | 6/2005 |
| WO | WO 92/12901 | 8/1992 |

OTHER PUBLICATIONS

International App No. PCT/US2011/040142, International Filing Date: Jun. 13, 2011 PCT Notification, Search Report and Written Opinion, Aug. 30, 2011.

* cited by examiner

*Primary Examiner* — Tri Mai

(57) ABSTRACT

A bottle of one-piece construction includes a body having a shoulder, a neck finish and a neck extending from the shoulder to the neck finish. The shoulder and neck finish each have circular cross sections around respective axes, which preferably are coincident with a central axis of the bottle. A major portion of the neck has an oval cross section around a third axis, which preferably is coincident with the central axis, smoothly blending into the circular cross sections of the shoulder and neck finish. The oval cross section preferably is generally elliptical, having outwardly convex end portions and outwardly convex side portions extending between the end portions. The neck preferably has a substantially uniform wall thickness.

15 Claims, 3 Drawing Sheets

ELLIPTICAL BOTTLE NECK

The present disclosure relates to bottles, and more particularly to the geometry of the neck extending between the body and the neck finish of a bottle.

BACKGROUND AND SUMMARY OF THE DISCLOSURE

Bottles for beer or soda, for example, typically include a body having a shoulder, a neck finish contoured for application of a closure, and a neck extending between the shoulder and the neck finish. The bottle body and neck finish typically are coaxial, and the neck typically is of circular cross section around the axis of the body and neck finish. When it is attempted to empty the bottle rapidly, the bottle cannot readily vent, causing a spurted pour or "glugging" at the neck finish. It is a general object of the present disclosure to provide bottle having a neck contoured to facilitate faster product flow during pouring from the bottle.

The present disclosure embodies a number of aspects that can be implemented separately from or in combination with each other.

A bottle of one-piece construction, in accordance with one aspect of the present disclosure, includes a body having a shoulder, a neck finish and a neck extending from the shoulder to the neck finish. The shoulder and neck finish each have circular cross sections around respective axes, which preferably are coincident with a central axis of the bottle. A major portion of the neck has an oval cross section around a third axis, which preferably is coincident with the central axis, smoothly blending into the circular cross sections of the shoulder and neck finish. The oval cross section preferably is generally elliptical, having outwardly convex end portions and outwardly convex side portions extending between the end portions. The neck preferably has a substantially uniform wall thickness.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
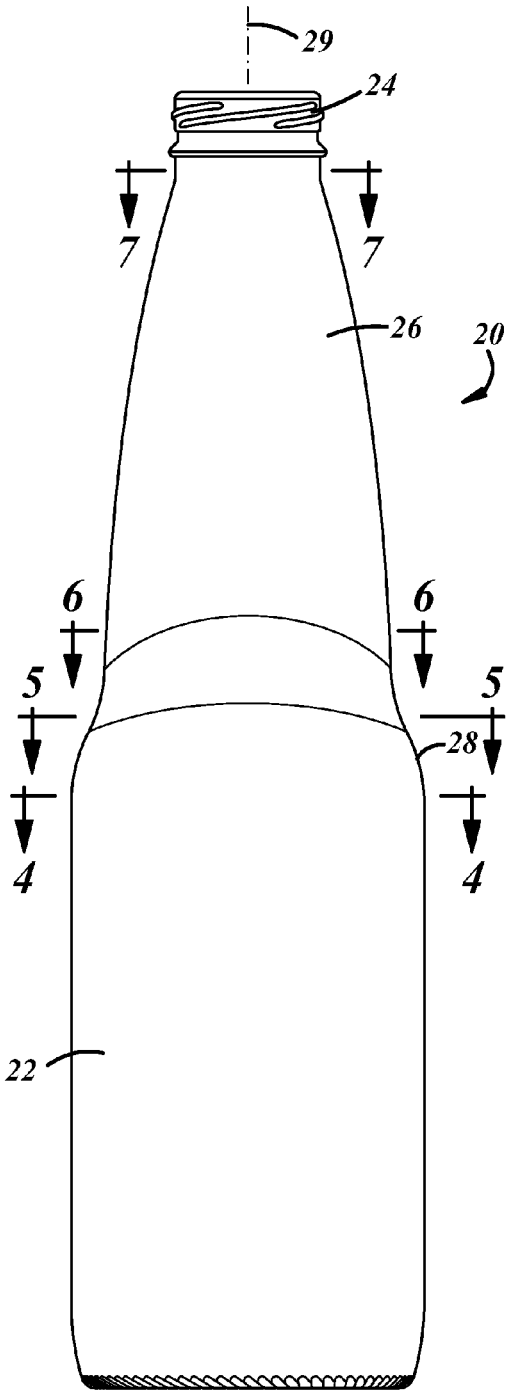
FIG. 1 is a front elevational view of a bottle in accordance with an exemplary embodiment of the present disclosure.
Figure 2:
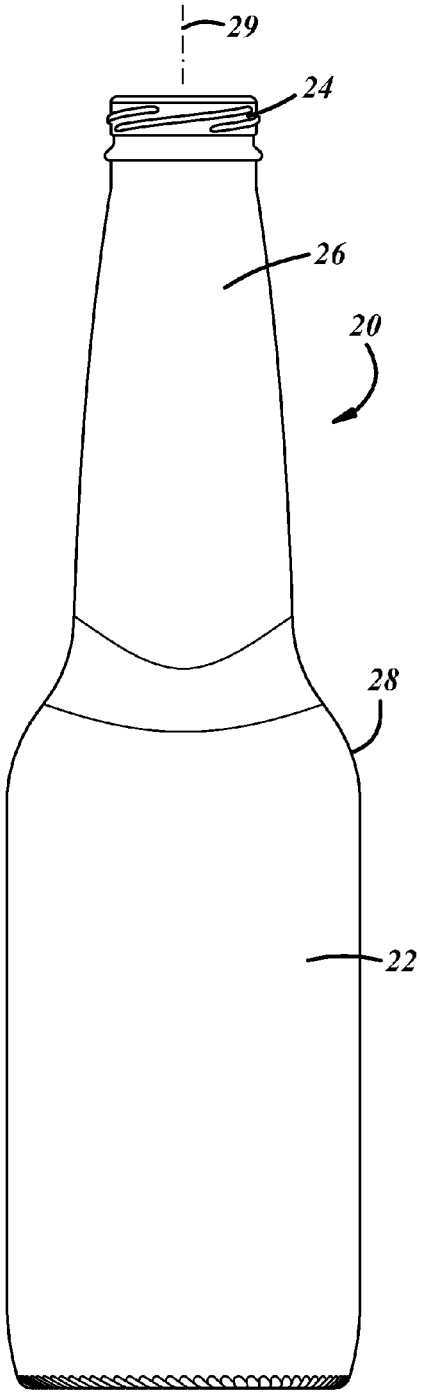
FIG. 2 is a side elevational view of the bottle in FIG. 1.

The drawings illustrate a bottle 20 in accordance with an exemplary embodiment of the present disclosure as including a body 22, a neck finish 24 and a neck 26 extending from neck finish 24 to the shoulder 28 of body 22. Bottle 20 preferably is of one-piece glass (FIGS. 1-7), plastic (FIGS. 1-3 and 12-15) or metal (FIGS. 1-3 and 8-10) construction and can be formed in any suitable manner. The geometries and contours of body 22, neck finish 24 and shoulder 28 illustrated in FIGS. 1-3 are exemplary only, and can be of any suitable geometries or contours.

Figure 3:
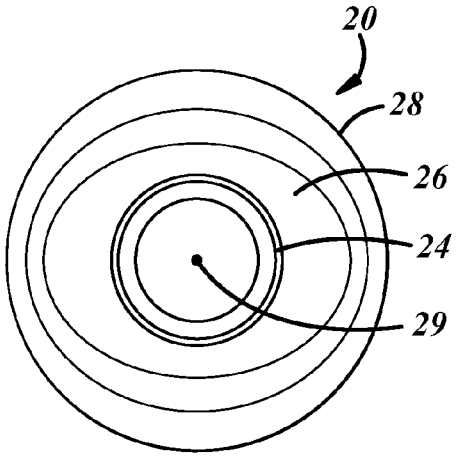
FIG. 3 is a top plan view of the bottle in FIG. 1.
Figure 4:
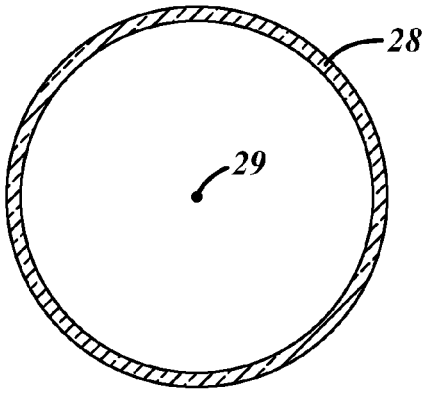
FIGS. 4-7 are sectional views of a glass bottle taken substantially along the respective lines 4-4, 5-5, 6-6 and 7-7 in FIG. 1.
Figure 6:
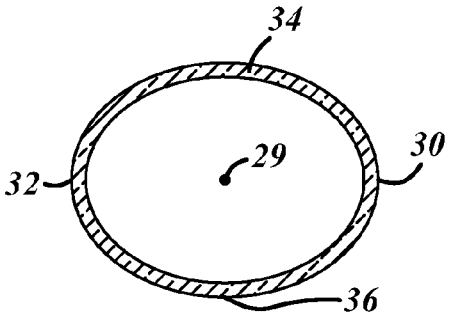
Figure 5:
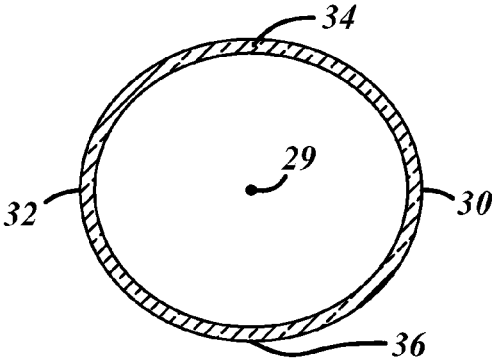
Figure 7:
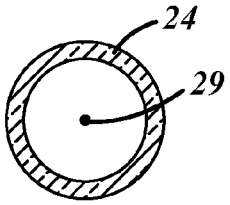
Figure 8:
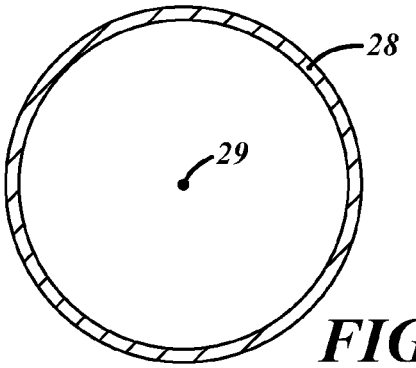
FIGS. 8-11 are sectional views similar to those of FIGS. 4-7 but for a metal bottle.
Figure 10:
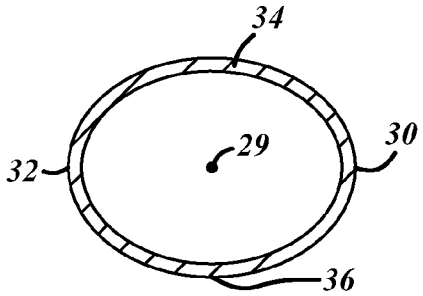
Figure 9:
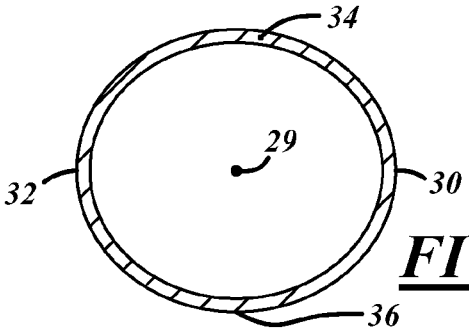
Figure 11:
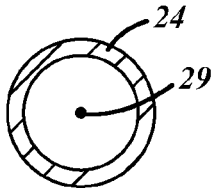
Figure 12:
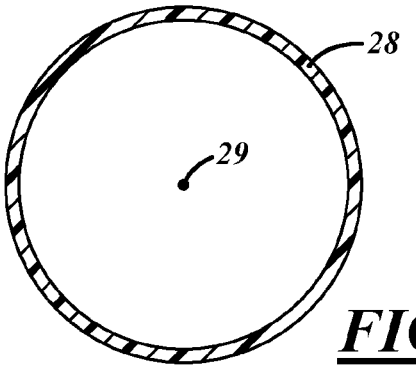
FIGS. 12-15 are sectional views similar to those of FIGS. 4-7 but for a plastic bottle.
Figure 14:
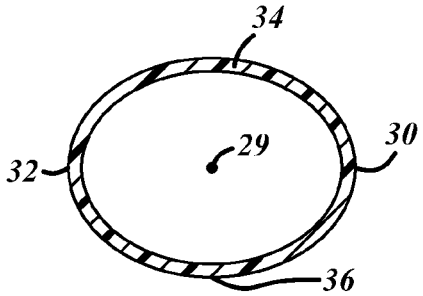
Figure 13:
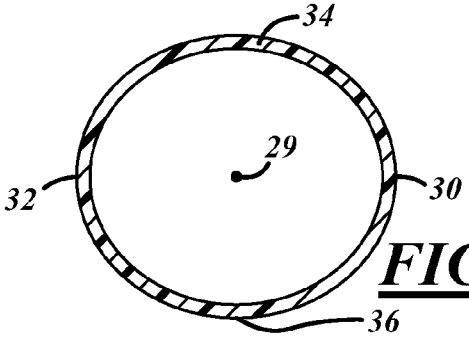
Figure 15:
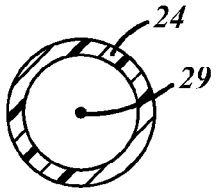

Neck finish 24 and shoulder 28 of body 22 preferably are of generally circular cross section, as best seen in FIGS. 3-4 and 7. (Terms such as "generally" and "substantially" in the present application mean within manufacturing tolerances.) Neck finish 24 and shoulder 28 preferably are coaxial with each other around the central axis 29 of bottle 20.

The major portion of neck 26 has an oval cross section that smoothly blends into the circular cross sections at shoulder 28 and neck finish 24. ("Smoothly" means without abrupt steps or surface discontinuities.) The oval cross section of neck 26 preferably is generally elliptical, having outwardly convex end portions 30, 32 (FIGS. 5-6) and outwardly convex side portions 34, 36 that extend between end portions 30, 32. End portions 30, 32 preferably are mirror images of each other, and side portions 34, 36 preferably also are mirror images of each other. In one example, the ratio of the "diameter" between portions 34, 36 to the "diameter" between portions 30, 32 is about 0.76. Other "oval" geometries could be employed, such as a geometry in which side portions 34, 36 are substantially flat and either parallel with or angled to each other, or a geometry in the shape of the longitudinal section of an egg.

Among other advantages, including aesthetic appeal, the oval-neck cross section of the present disclosure facilitates venting of the bottle, and rapid flow of product from the bottle reducing glugging. The oval-neck cross section also allows fruit (e.g., orange, lemon or lime slices) to reside in the bottle neck without restricting product flow. The oval-neck cross section also provides improved ergonomics (better grip) and a larger area for a neck label.

There thus has been disclosed an oval-neck bottle that fully achieves all of the objects and aims previously set forth. The oval-neck bottle has been disclosed in conjunction with a presently preferred embodiment, and modifications and variations have been discussed. Other modifications and variations readily will suggest themselves to persons of ordinary skill in the art in view of the foregoing description. The present disclosure is intended to encompass all such modifications and variations as fall within the spirit and broad scope of the appended claims.

The invention claimed is:

1. A bottle of one-piece construction that includes:

a body having a shoulder, a neck finish and a neck extending from said shoulder to said neck finish, said shoulder having a circular cross section around and perpendicular to a central axis of the bottle, said neck finish having a circular cross section around and perpendicular to the central axis, and a major portion of said neck having an elliptical cross section around and perpendicular to the central axis smoothly blending into said circular cross sections at said shoulder and said neck finish, wherein said major portion of said neck bulges convexly radially outward along its length.

2. The bottle set forth in claim 1 wherein said elliptical cross section has outwardly convex end portions and outwardly convex side portions extending between said end portions.

3. The bottle set forth in claim 1 wherein said neck has a substantially uniform wall thickness.

4. The bottle set forth in claim 1 wherein said elliptical cross section has outwardly convex end portions and outwardly convex side portions extending between said end portions, wherein said end portions are mirror images of each other and said side portions are mirror images of each other.

5. The bottle set forth in claim 4 wherein a ratio between diameters of said side portions and said end portions is 0.76.

6. The bottle set forth in claim 1 wherein said body is generally cylindrical.

7. The bottle set forth in claim 1 wherein said elliptical cross section is smooth about its circumference without abrupt steps or surface discontinuities.

8. A bottle of one-piece glass, metal or plastic construction that includes:

a body having a shoulder, a neck finish and a neck extending between said shoulder and said neck finish, said shoulder having a circular cross section around and perpendicular to a central axis of the bottle, said neck finish having a circular cross section around and perpendicular to said central axis, and a major portion of said neck having an elliptical cross section around and perpendicular to said central axis and smoothly blending into said circular cross sections at said shoulder and said neck finish, wherein said major portion of said neck bulges convexly radially outward along its length, said elliptical cross section having outwardly convex end portions and outwardly convex side portions extending between said end portions, wherein said end portions are mirror images of each other and said side portions are mirror images of each other.

9. The bottle set forth in claim 8 wherein said neck has a substantially uniform wall thickness.

10. The bottle set forth in claim 8 wherein said body is generally cylindrical.

11. The bottle set forth in claim 8 wherein a ratio between diameters of said side portions and said end portions is 0.76.

12. The bottle set forth in claim 8 wherein said elliptical cross section is smooth about its circumference without abrupt steps or surface discontinuities.

13. A bottle of one-piece glass, metal or plastic construction that includes:

a generally cylindrical body with a shoulder having a circular cross section around and perpendicular to a central axis of the bottle, a neck finish having a circular cross section around and perpendicular to the central axis, and a neck extending between the shoulder and the neck finish and being of substantially uniform wall thickness, wherein a major portion of the neck has an elliptical cross section around and perpendicular to the central axis that smoothly blends into the circular cross sections at the shoulder and the neck finish, wherein said major portion of said neck bulges convexly radially outward along its length, the elliptical cross section having mirror-image outwardly convex end portions and mirror-image outwardly convex side portions extending between the end portions.

14. The bottle set forth in claim 13 wherein a ratio between diameters of the side portions and the end portions is 0.76.

15. The bottle set forth in claim 13 wherein said elliptical cross section is smooth about its circumference without abrupt steps or surface discontinuities.

* * * * *